US006334535B1

(12) United States Patent
Korhonen

(10) Patent No.: US 6,334,535 B1
(45) Date of Patent: Jan. 1, 2002

(54) PACKING COVER

(76) Inventor: Seppo Korhonen, Yläkuja 2, FIN-55800, Imatra (FI)

( * ) Notice: Subject to any disclaimer, the term of this patent is extended or adjusted under 35 U.S.C. 154(b) by 0 days.

(21) Appl. No.: 09/601,924

(22) PCT Filed: Feb. 11, 1999

(86) PCT No.: PCT/FI99/00108

§ 371 Date: Aug. 10, 2000

§ 102(e) Date: Aug. 10, 2000

(87) PCT Pub. No.: WO99/41161

PCT Pub. Date: Aug. 19, 1999

(30) Foreign Application Priority Data

Feb. 12, 1998 (FI) ..... 980325

(51) Int. Cl.[7] ..... B65D 81/05
(52) U.S. Cl. ..... 206/453; 428/181
(58) Field of Search ..... 40/740, 791, 794; 206/1.7, 453, 586; 229/67.3; 428/181

(56) References Cited

U.S. PATENT DOCUMENTS 2,896,833 A 7/1959 Markham ..... 206/454
5,604,011 A * 2/1997 Morely ..... 206/453
5,871,194 A * 2/1999 Morely ..... 206/586
6,039,184 A * 3/2000 Gale ..... 206/586
6,054,194 A * 4/2000 Kane ..... 428/181

FOREIGN PATENT DOCUMENTS

| | | |
|---|---|---|
| DE | 196 06 546 | 4/1997 |
| WO | WO 94/04430 | 3/1994 |
| WO | WO 96/02435 | 2/1996 |

* cited by examiner

*Primary Examiner*—Jim Foster
(74) *Attorney, Agent, or Firm*—Young & Thompson

(57) ABSTRACT

Packing protector for protecting the edge areas of a sheet-like object, said packing protector consisting of an edge protector (1) formed by narrow strips and of flanges (2, 3) extending from the edge protector to opposite surfaces of the object to be protected, both the edge protector and the flanges being preferably manufactured from cardboard. According to the invention, the edge protector (1) comprises joining areas (4) connecting adjacent strips (5) of the edge protector together so as to press the flanges obliquely toward each other.

12 Claims, 2 Drawing Sheets

PACKING COVER

Figure 1:
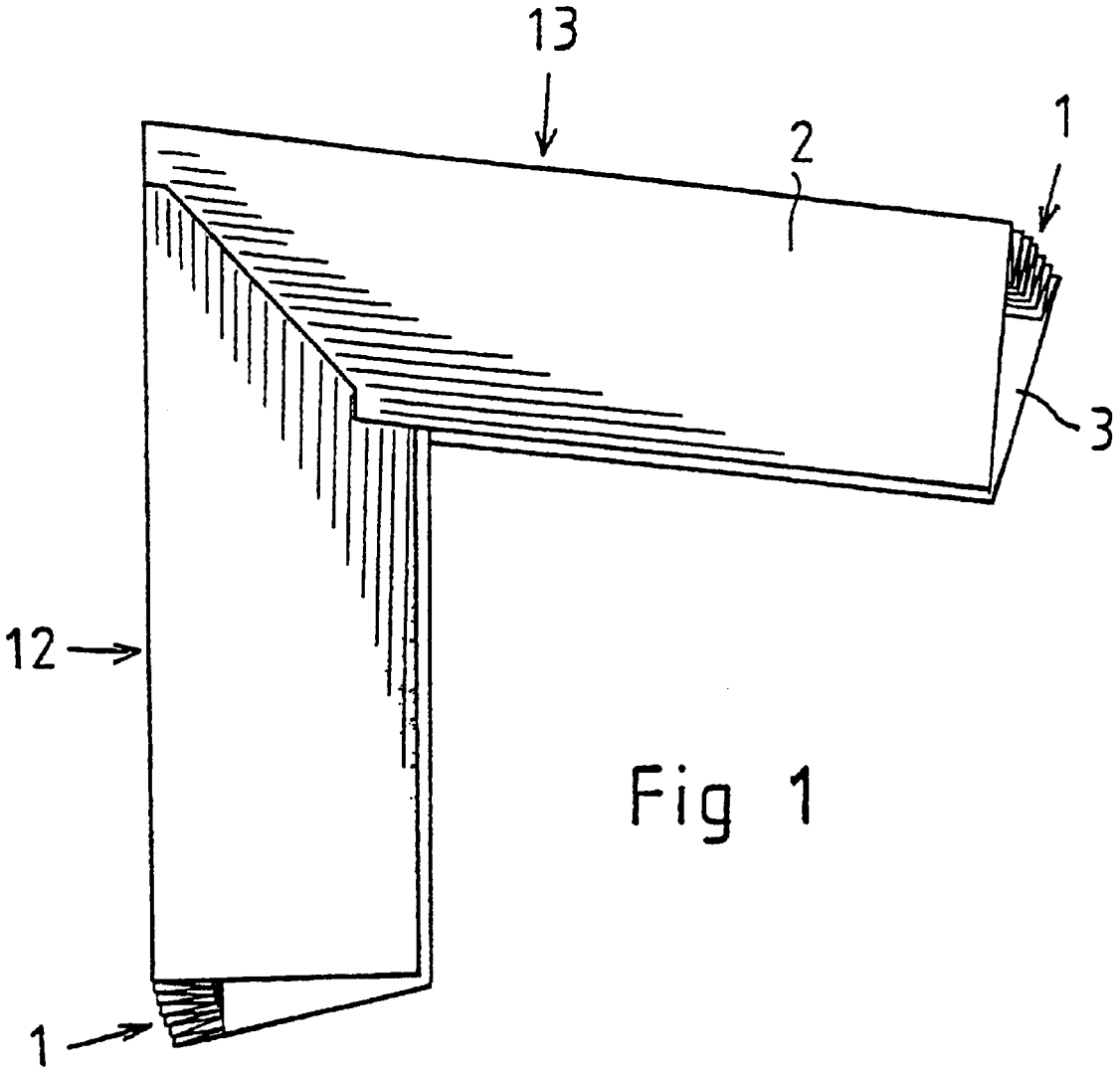

The present invention relates to a packing protector as defined in the preamble of claim 1.

Packing protectors like those purported by the invention are used to protect the corners and edges of various sheet-like structures against damage e.g. during transportation. A packing protector of this type is presented in German application publication 19606546. This packing protector is made of paper material folded so as to form an accordion or bellows type structure which can be used to protect various objects. However, this structure is in many respects unsatisfactory. It does not provide sufficient protection for the desired object and, especially when used as a corner protector, it leaves the extremity of the corner of the object very poorly protected. In addition, the protector is difficult to mount and especially its capability to stay in position is poor.

A solution designed to eliminate the above-mentioned drawbacks is e.g. an elastic corner protector made of plastic as presented in Finnish utility design application 950381. This corner protector has an elasticity property, so it can be used to protect products having different thickness dimensions and it also effectively protects the tip of the corner. The main problem with this product is the raw material used. As corner protectors are bulk goods, they are needed in large quantities, and consequently a lot of waste is produced.

The object of the present invention is to eliminate the drawbacks described above. A specific object of the present invention is to disclose a new type of packing protector which can be manufactured e.g. from recycled cardboard and provides effective protection for products in spite of this readily destructible or recyclable material, is easy and simple to use and also permits large variations in the thickness of the product to be protected.

As for the features characteristic of the invention, reference is made to the claims.

The packing protector of the invention preferably consists of an edge protector formed by narrow strips and of flanges extending in the same direction from the edge protector and designed to be placed on opposite surfaces of the object to be protected, both the edge protector and the flanges being manufactured e.g. from recycled cardboard. According to the invention, the edge protector comprised in the packing protector is provided with joining areas suitably connecting adjacent cardboard strips of the edge protector together so that the flanges of the packing protector do not remain exactly parallel to each other but are obliquely converging, in other words, the distance between the flanges at their free edges is shorter than the width of the edge protector, or the flange edges may even touch each other. Therefore, according to the invention, the packing protector can be placed on the edge of the object to be protected as the flanges are pressed against the surfaces of the object and keep the packing protector in place without any glue, tape or other agents between the packing protector and the object to be protected.

The packing protector is preferably manufactured from a single continuous cardboard sheet by folding the middle portion of the sheet alternately in different directions to form narrow parallel strips of equal width which constitute an accordion or bellows type edge protector. The edge parts of the sheet are then bent to form extensions of the outermost strips, forming flanges extending side by side in the same direction.

In another embodiment of the invention, the edge protector is manufactured from cardboard strips of equal width which are glued together at suitable distances, the gluing being effected in a staggered manner so that the glue spots are not in the same line between each layer across the whole width of the edge protector. In this way, an edge protector of elastic and bellows-like structure is produced. The broader flanges can then be glued to the two edges of the edge protector so that, due to the elasticity of the edge protector, the flanges will be pressed against the parallel surfaces of the object to be protected.

The joining areas used in the strips are preferably glue spots or larger areas provided with glue. The joining areas are preferably disposed on those surfaces of the bellows-like edge protector which in the finished packing protector face toward the flanges, in other words, on the strip surfaces facing toward the inside of the packing protector.

In a preferred embodiment of the invention, the strips forming the edge protector are not completely glued to each other at their inner surfaces. Instead, they have joining areas at suitable distances, the joining areas in different strips being preferably disposed along the same line in the widthways direction of the edge protector and at suitable distances from each other in the lengthways direction of the edge protector.

In a preferred embodiment of the invention, the folds between the edge protector strips are provided with incisions to increase the elasticity of the edge protector, i.e. of the bellows-like structure of the packing protector. The incisions may be placed e.g. along the same line with the joining areas. In a preferred embodiment, the incisions are disposed along the same line with the joining areas but only in the inner folds between strips, so that the incisions are not visible from the outside of the finished packing protector, but the accordion-like back of the packing protector looks solid and whole.

A packing protector as described above can be used on straight edges of sheet-like structures. In an embodiment of the invention, the packing protector is provided with a crosscut which in the finished packing protector extends from the direction of the flanges toward the edge protector, cutting through most of the edge protector. Thus, only in the area of the outer folds between the strips and in the area of the folds between the outermost strips and the flanges, narrow necks are formed which constitute a joint along the crosscut, connecting the two parts of the packing protector thus formed on either side of the crosscut and permitting these parts to be bent to an angle relative to each other. In another alternative, the crosscut is not started right from the edge of the flanges but instead a small bridge is left at the beginning of the crosscut to enable the packing protector to remain straight and rigid, and only when the packing protector is to be used in an angular shape, the bridges are torn or broken e.g. by bending in the reverse direction. Thus, the same packing protector with a crosscut allowing its use as a corner protector can just as well be used as a straight protector on straight edges of objects.

In a preferred embodiment of the invention, the crosscut is disposed alongside a line of joining areas connecting the strips together and corresponding incisions in the inner folds between the strips so that the joining areas and incisions lie on one side of the crosscut. In this case, the strips on the other side of the crosscut are connected by both the inner and outer folds and have no joining areas keeping them together. Thus, when the two parts of the packing protector are bent to an angle, the strip portions on either side of the crosscut will intermesh and will not prevent the parts from being bent to an angle. At the same time, a strong double protection is formed in the intermeshing area at the vertex of the angle, which effectively protects the tip of the corner of the object.

As compared with prior art, the packing protector of the invention has significant advantages. Although the packing protector can be manufactured e.g. from cheap recycled cardboard, which can be readily recycled or destroyed, the packing protector has an elastic structure, even in two senses. First, thanks to the elasticity of the flanges and their skew toward each other, the packing protector remains in position around the object to be protected, so it need not be held fast during packaging, thus allowing faster and easier packaging. Second, the back part of the packing protector, i.e. the bellows-like edge protector, is flexible in width, thus allowing one and the same packing protector size to be used for a large number of objects of different thickness dimensions. Moreover, it is not necessary to have separate protectors for straight edges and corners, but the same packing protector can be used to protect straight edges and bent to an angle to protect corners.

Figure 2:
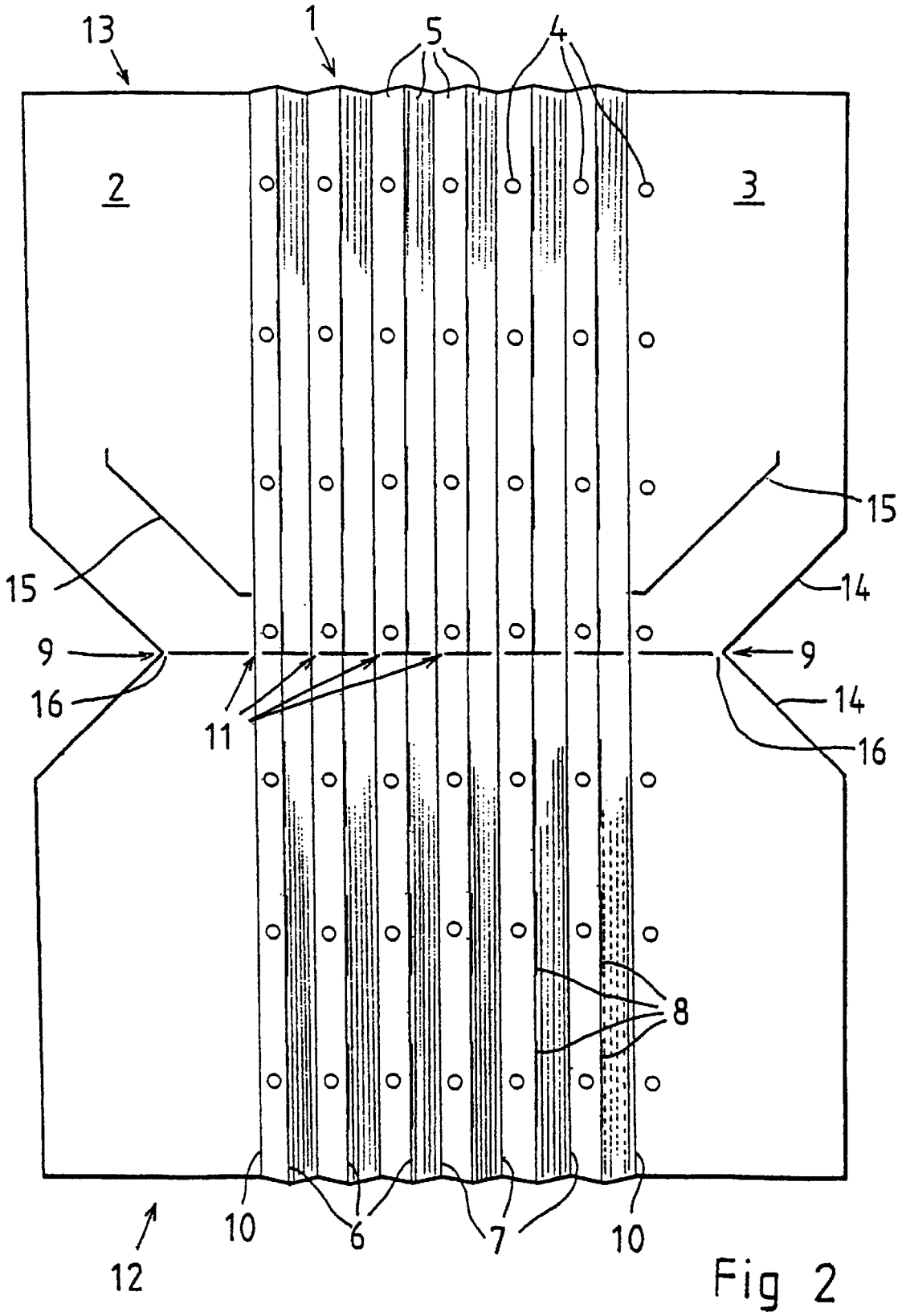

In the following, the invention will be described in detail with reference to the attached drawings, wherein FIG. 1 presents a packing protector according to the invention, and FIG. 2 presents a blank with a crosscut, from which the packing protector illustrated in FIG. 1 has been formed.

The packing protector presented in FIG. 1, which is designed for the protection of a corner of a sheet-like object, has been manufactured from a cardboard blank as illustrated in FIG. 2. The blank is of a substantially rectangular shape and it has straight planar flanges 2 and 3 of equal width and length at its edges. Between the flanges is the part which forms the edge protector 1 in the packing protector. It consists of thirteen parallel creasing lines placed at equal distances from each other, forming between the flanges 2 and 3 an accordion or bellows type structure comprising twelve narrow strips 5.

Every second strip is provided with glue spots 4 placed at the same level in different strips and at a distance from each other in the longitudinal direction of the strips. In the area of the glue spots, every second fold, i.e. the inner folds 6 are provided with incisions 8, in other words, the inner folds have been cut open in these areas.

In addition, the blank is provided with a crosscut 9 that nearly cuts the blank in two in its middle portion transversely to the longitudinal direction of the strips 5. The crosscut 9 begins from the bottom of indentations or bevellings 14 made in the flanges 2 and 3, yet so that small bridges 16 are initially left in the blank. The crosscut then continues in an intermittent fashion so that a break is left in the crosscut at each outer fold 7 between strips 5 and at the folds 10 between the outermost strips and the flanges, said breaks forming a joint 11.

The crosscut 9 is so disposed that there are joining areas and also incisions 8 in the strips 5 immediately on one side of the crosscut whereas immediately on the other side of the crosscut 9 there are no joining areas and no corresponding incisions.

Moreover, on one side of the crosscut 9, the flanges 2 and 3 are provided with locking incisions 15 for interlocking the flanges when the packing protector is bent to an angle.

When blank illustrated in FIG. 2 is turned and pressed together, i.e. when the joining areas 4 are pressed against the opposite strip 5 or flange 2, a straight elastic packing protector is formed in which the flanges 2 and 3 are aslant toward each other as illustrated in FIG. 1. When the packing protector is to be bent to form a corner protector as illustrated in FIG. 1, the sections 12 and 13 of the packing protector are bent about the joint 11, first slightly in the reverse direction, thus breaking the bridges 16. After this, the two sections 12 and 13 are bent to an angle relative to each other. As a result, the strip 5 areas in different sections 12 and 13 around the crosscut 9 intermesh, forming a thick and firm corner protection. At the same time, the bevelled indentations 14 in section 12 are pressed into the locking incisions 15 in the flanges in section 13, this causing the two sections 12 and 13 to interlock at straight angles without being glued. However, it is also possible to use glued connections here either instead of locking incisions or in addition to them.

In the foregoing, the invention has been described by way of example with reference to the attached drawings, but different embodiments of the invention are possible within the scope of the inventive idea defined in the claims.

What is claimed is:

1. Packing protector for protecting the edge areas of a sheet-like object, said packing protector consisting of an edge protector (1) and of flanges (2, 3) extending from the edge protector to opposite surfaces of the object to be protected, both the edge protector and the flanges being manufactured from cardboard, characterised in that the flanges (2, 3) and the edge protector (1) have been produced from a continuous cardboard sheet by folding it so that edge protector formed by narrow strips (5) forms an accordion or bellows type structure comprising joining areas (4) connecting adjacent strips (5) of the edge protector together so as to press the flanges obliquely toward each other.

2. Packing protector as defined in claim 1, characterised in that the joining areas (4) consist of glue spots.

3. Packing protector as defined in claim 1, characterised in that the joining areas (4) are disposed on the strip (5) surfaces facing toward the flanges.

4. Packing protector as defined in claim 1, characterised in that the joining areas (4) in different strips (5) are disposed along the same line across the width of the edge protector and at a distance from each other in the lengthways direction of the edge protector.

5. Packing protector as defined in claim 1, characterised in that the fold (6, 7) between the strips (5) is provided with incisions (8) to increase the elasticity of the edge protector in its widthways direction.

6. Packing protector as defined in claim 5, characterised in that the incisions (8) are placed along the same line with the joining areas (4).

7. Packing protector as defined in claim 5, characterised in that the incisions (8) are disposed in the inner folds (6) between strips (5).

8. Packing protector as defined in claim 1, characterised in that the packing protector is provided with a crosscut (9) cutting through a substantial portion of the flanges (2, 3) and edge protector (1) while the outer folds (7) between strips (5) and the folds (10) between the outermost strips and the flanges form a joint (11) along the crosscut line to allow the two parts (12, 13) of the packing protector to be bent to an angle relative to each other.

9. Packing protector as defined in claim 8, characterised in that the crosscut (9) is disposed alongside a line of joining areas and corresponding incisions (8) in the inner folds (6) between the strips (5) so that the joining areas and incisions lie on one side of the crosscut while the strips on the other side of the crosscut are connected together by the folds and are free of joining areas.

10. Packing protector as defined in claim 8, characterised in that the flanges (2, 3) are provided with bevelled indentations (14) at the edges of the crosscut (9) to allow the two parts (12, 13) of the packing protector to be bent to an angle of 90° relative to each other.

11. Packing protector as defined in claim 8, characterised in that the flange (2, 3) is provided with a locking incision (15) near the crosscut (9) to allow the flanges to be interlocked when the parts of the packing protector are bent to an angle relative to each other.

12. Packing protector as defined in claim 8, characterised in that the edge of the flange (2, 3) comprises a bridge (16) at the beginning of the crosscut (9), which bridge is only torn when the packing protector is being bent to an angle.

* * * * *